US009784038B2

(12) United States Patent
Case et al.

(10) Patent No.: US 9,784,038 B2
(45) Date of Patent: Oct. 10, 2017

(54) HIGH-PRODUCTIVITY DRILL BITS

(71) Applicant: Longyear TM, Inc., South Jordan, UT (US)

(72) Inventors: Michael Case, Mississauga (CA); Jeff Hogan, Brampton (CA); Tushar Matkar, Mississauga (CA)

(73) Assignee: Longyear TM, Inc., Salt Lake City, UT (US)

( * ) Notice: Subject to any disclaimer, the term of this patent is extended or adjusted under 35 U.S.C. 154(b) by 364 days.

(21) Appl. No.: 14/034,605

(22) Filed: Sep. 24, 2013

(65) Prior Publication Data

US 2014/0367171 A1 Dec. 18, 2014

Related U.S. Application Data

(60) Provisional application No. 61/836,048, filed on Jun. 17, 2013.

(51) Int. Cl.
*E21B 10/60* (2006.01)
*E21B 10/38* (2006.01)

(52) U.S. Cl.
CPC ..... *E21B 10/60* (2013.01); *E21B 10/38* (2013.01)

(58) Field of Classification Search
CPC ..... E21B 10/003; E21B 10/18; E21B 10/083; E21B 10/23
USPC ..... 175/57
See application file for complete search history.

(56) References Cited

U.S. PATENT DOCUMENTS

| | | | | |
|---|---|---|---|---|
| 3,930,749 | A * | 1/1976 | Gusman | E21B 4/02 415/199.5 |
| 5,303,785 | A * | 4/1994 | Duke | E21B 10/54 175/420.2 |
| 5,836,404 | A * | 11/1998 | Trujillo | E21B 10/18 175/339 |
| 2004/0065482 | A1 | 4/2004 | Larsson | |
| 2010/0025114 | A1* | 2/2010 | Brady | E21B 10/36 175/57 |
| 2012/0061146 | A1* | 3/2012 | Pearce | E21B 10/02 175/58 |
| 2012/0325558 | A1 | 12/2012 | Lundberg et al. | |
| 2013/0209184 | A1* | 8/2013 | Barry | B23C 5/10 407/54 |

FOREIGN PATENT DOCUMENTS

| | | | |
|---|---|---|---|
| DE | 4326000 | A1 | 2/1995 |
| EP | 0269400 | A2 | 6/1988 |
| EP | 0874127 | A2 | 10/1998 |

(Continued)

OTHER PUBLICATIONS

Grundstrom et al. Maximizing Sag Mill Through put at Porgera Gold Mine by Optimizing Blast Fragmentation. SAG 2001. University of British Columbia. p. I-271.*

(Continued)

*Primary Examiner* — Giovanna C Wright
*Assistant Examiner* — Manuel C Portocarrero
(74) *Attorney, Agent, or Firm* — Ballard Spahr LLP

(57) ABSTRACT

Drill bits having flushing channels and surface features that cooperate to evacuate cuttings. The surface features can be provided as flutes, fins, and/or ribs defined in a body portion of the bits. Optionally, the surface features can define back-cutting edges the permit back reaming.

22 Claims, 18 Drawing Sheets

(56) References Cited

FOREIGN PATENT DOCUMENTS

| | | | | | |
|---|---|---|---|---|---|
| EP | 2966254 | A1 | | 1/2016 | |
| GB | 2212091 | A | | 7/1989 | |
| SE | WO2011112137 | A1 | * | 9/2011 | ..... E21B 10/38 |
| WO | WO-2004/104362 | A1 | | 12/2004 | |
| WO | WO-2012/036849 | A2 | | 3/2012 | |
| ZA | WO 2011157667 | A1 | * | 12/2011 | ..... B23C 5/10 |
| ZA | WO2011157667 | A1 | * | 12/2011 | ..... B23C 5/10 |

OTHER PUBLICATIONS

Dictionary definition of "formation", accessed on Mar. 31, 2016 via www.thefreedictionary.com.*

Definition of "formation", accessed on Aug. 12, 2016 via encyclopedia.thefreedictionary.com.*

Definition of "Back Reaming", accessed on Aug. 12, 2016 via www.jackson-creek.com.*

International Search Report issued Oct. 8, 2014 by the International Searching Authority for Application No. PCT/US2014/042760, which was filed Jun. 17, 2014 and published as WO/2014/204975 on Dec. 24, 2014 (Inventor—Michael Case, et al. // Applicant—Longyear TM, Inc. //) (3 Pages).

European Search Report was dated on Jan. 17, 2017 by the European Patent Office for EP Application No. 14813541.1, which was filed on Jun. 17, 2014 and published as 3011124 on Apr. 27, 2016 (Applicant-.Longyear TM, Inc.)(7 pages).

Communication Pursuant to Rules 70(2) and 70(a) EPC was dated on Feb. 3, 2017 by the European Patent Office for EP Application No. 14813541.1, which was filed on Jun. 17, 2014 and published as 3011124 on Apr. 27, 2016 (Applicant-.Longyear TM, Inc.)(1 page).

* cited by examiner

HIGH-PRODUCTIVITY DRILL BITS

CROSS-REFERENCE TO RELATED APPLICATION

This application claims the benefit of the filing date of U.S. Provisional Patent Application No. 61/836,048, filed Jun. 17, 2013, which is incorporated by reference herein in its entirety.

FIELD

This invention relates to a bit for use in drilling operations and, more particularly, to drill bits for evacuating cuttings from a drill hole.

BACKGROUND

In current in-hole reaming applications, the total drilling time is significantly less than the time required to remove a drill string from a hole. The removal of the drill string is typically slowed down by the jamming of cuttings behind the bit face. Drill string removal takes even longer under adverse ground conditions, such as soft and/or broken ground conditions. Under these adverse conditions, conventional drill strings are often lost in the hole.

Thus, there is a need in the pertinent art for reaming bits that improve evacuation of cuttings within a drill hole and expedite the removal of drill strings from a drill hole.

SUMMARY

Described herein is a bit for use in drilling operations, such as forming a hole within a formation. Optionally, the formation can comprise rock. The bit can have a central longitudinal axis, a bit face having a top surface, and a body portion extending axially away from the bit face. The body portion of the bit can have an exterior surface and a proximal portion that defines a plurality of surface features. At least a portion of each surface feature can be configured for back reaming during formation of the hole. The body portion and the bit face can cooperate to define a plurality of circumferentially spaced flushing channels. The plurality of surface features can cooperate with the plurality of flushing channels to remove cuttings from the hole as the hole is formed.

Optionally, the plurality of surface features can be a plurality of flutes defined within the exterior surface of the body portion. Each flute can be angularly oriented relative to the central longitudinal axis.

Optionally, the plurality of surface features can be a plurality of fins that project outwardly from the body portion. Each fin of the plurality of fins can optionally be positioned in communication with at least one flushing channel of the plurality of flushing channels.

Optionally, the plurality of surface features can be a plurality of ribs that project outwardly from the proximal portion of the body portion. Each rib of the plurality of ribs can optionally be positioned in communication with at least one flushing channel of the plurality of flushing channels. Each rib of the plurality of ribs can optionally be angularly oriented relative to the central longitudinal axis.

Optionally, the top surface of the bit face can have a generally rounded profile. The bit face can define at least one projection that extends from the top surface of the bit face. The top surface of the bit face can define at least one bore proximate the central axis of the bit. The at least one bore can extend into an interior portion of the bit. The bore can be positioned in fluid communication with a longitudinally extending central channel defined within the bit. In one aspect, the central channel can be in selective communication with a source of pressurized flushing medium. The pressurized flushing medium can be provided to the top surface of the bit face via the fluidly connected central channel and the at least one bore.

In use, the drill bit can allow cuttings to be removed from a formed hole. The cuttings can generally be carried through the flushing channels by the pressurized flushing medium that is confined between the flushing channels of the drill bit and the inner wall surface of the formed hole.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein:

FIGS. 1A-3B depict exemplary reaming bits as disclosed herein. The reaming bits of FIGS. 1A-3B have a plurality of spaced flutes that define a leading (cutting) edge.

FIG. 1A is a front perspective view of an exemplary reaming bit, and FIG. 1B provides various technical views of the reaming bit. FIG. 1C is an isolated side view of an exemplary flute of a drill bit as disclosed herein. FIG. 1D is a cross-sectional view of an exemplary drill bit, taken along a first wall surface, which is exemplarity shown positioned in a first plane that contains a planar chord as disclosed herein.

Figure 4A:
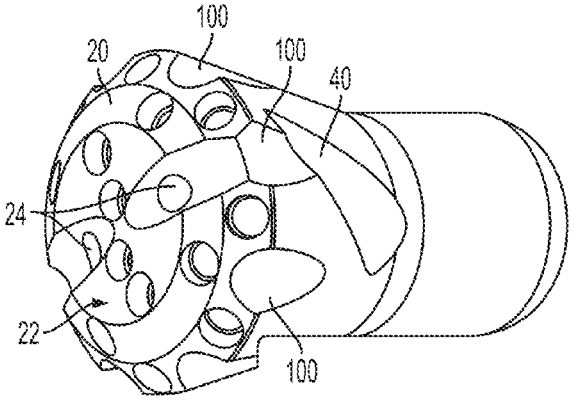
Figure 4B:
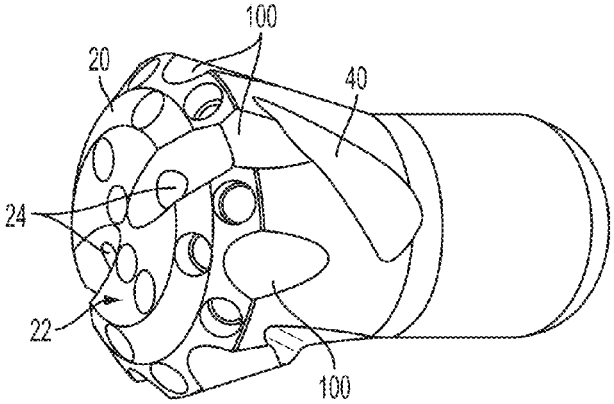

FIGS. 4A-4B schematically depict the formation of a flute on the outer surface of a reaming bit as disclosed herein. The orientation of the reaming bit depicted in FIG. 4A corresponds to the relative orientation of the reaming bit when a straight cut was made into the bit to form the flute. In operation, when the reaming bit is rotated until its central axis is substantially within the plane of the drawing page (see the orientation of the reaming bit depicted in FIG. 4B), the angular orientation of the flute relative to the central axis of the bit is visible.

Figure 5A:
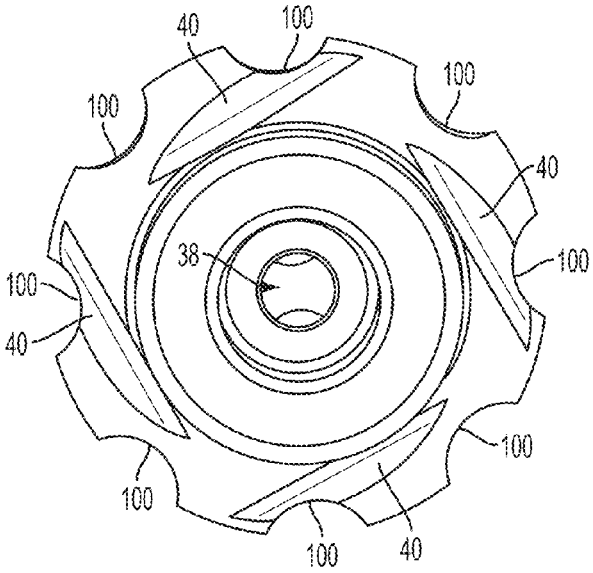
Figure 5B:
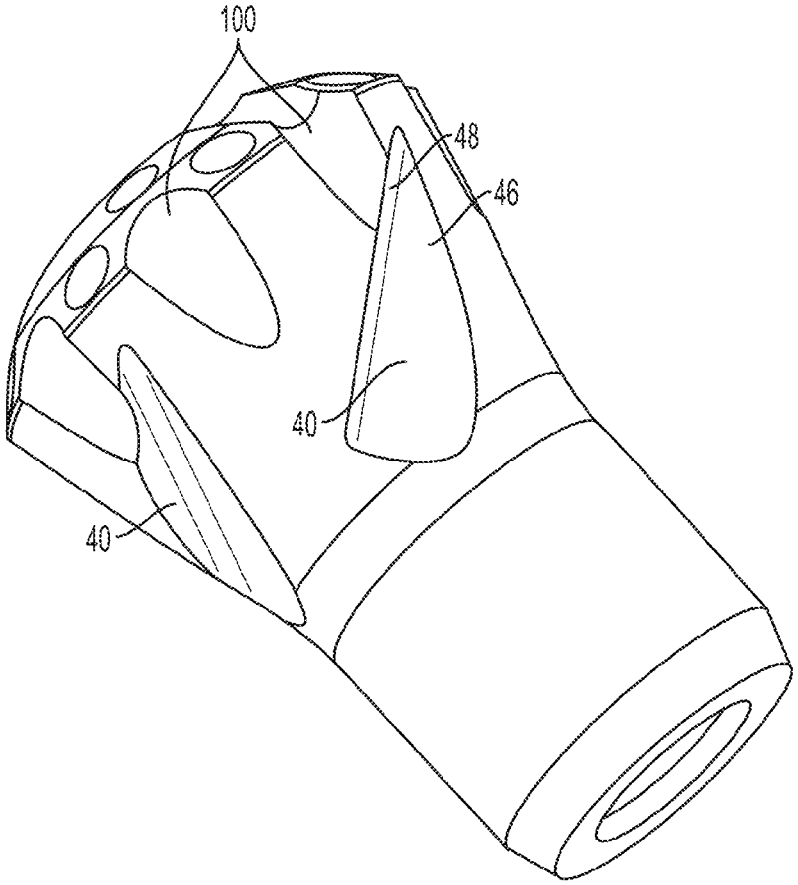
Figure 5C:
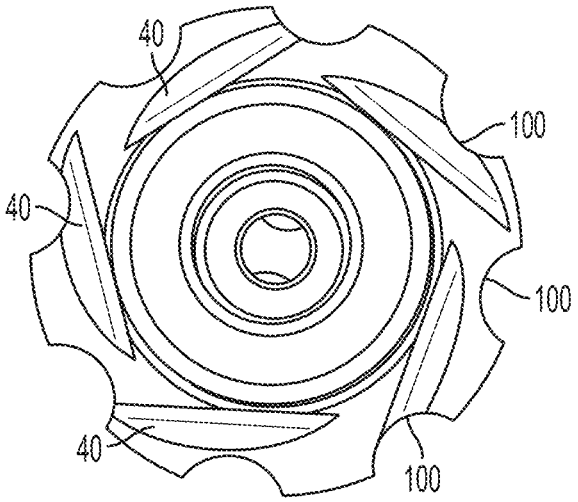
Figure 5D:
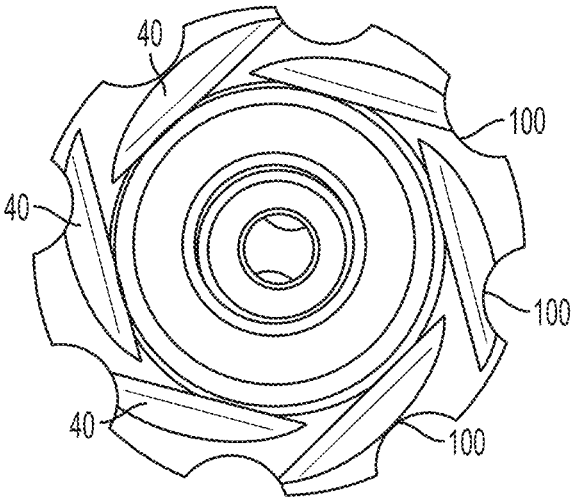
Figure 5E:
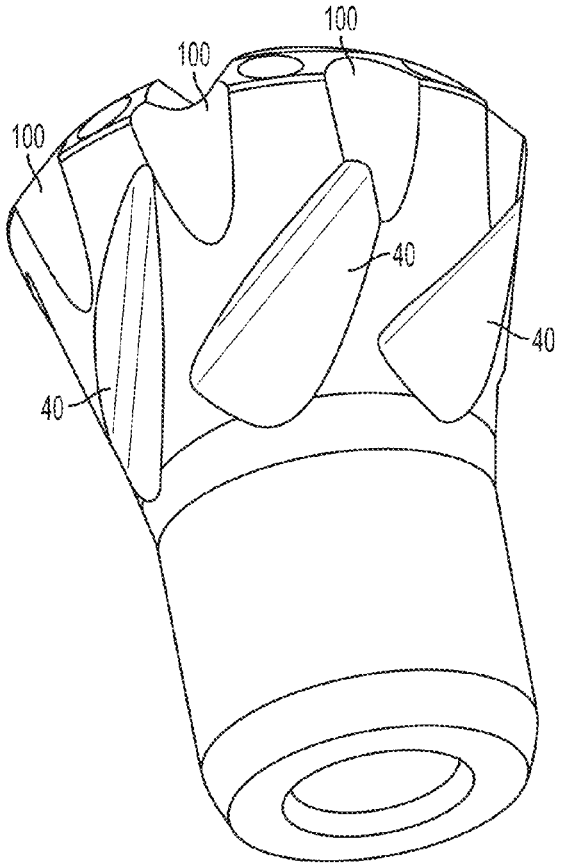

FIGS. 5A and 5B depict an exemplary reaming bit having four circumferentially spaced flutes as disclosed herein. FIG. 5C depicts an exemplary reaming bit having five circumferentially spaced flutes as disclosed herein. FIGS. 5D and 5E depict an exemplary reaming bit having six circumferentially spaced flutes as disclosed herein.

Figure 6:
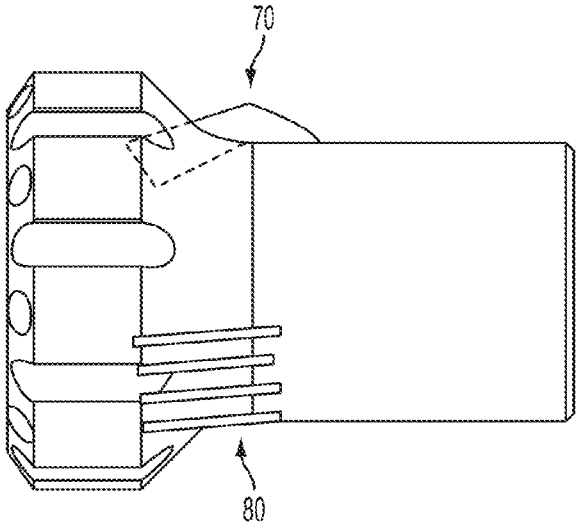

FIG. 6 depicts a drill bit having optional fin elements and straight ribs, which, as further disclosed herein, can be used in place of or in conjunction with the helical flutes disclosed herein.

Figure 7:
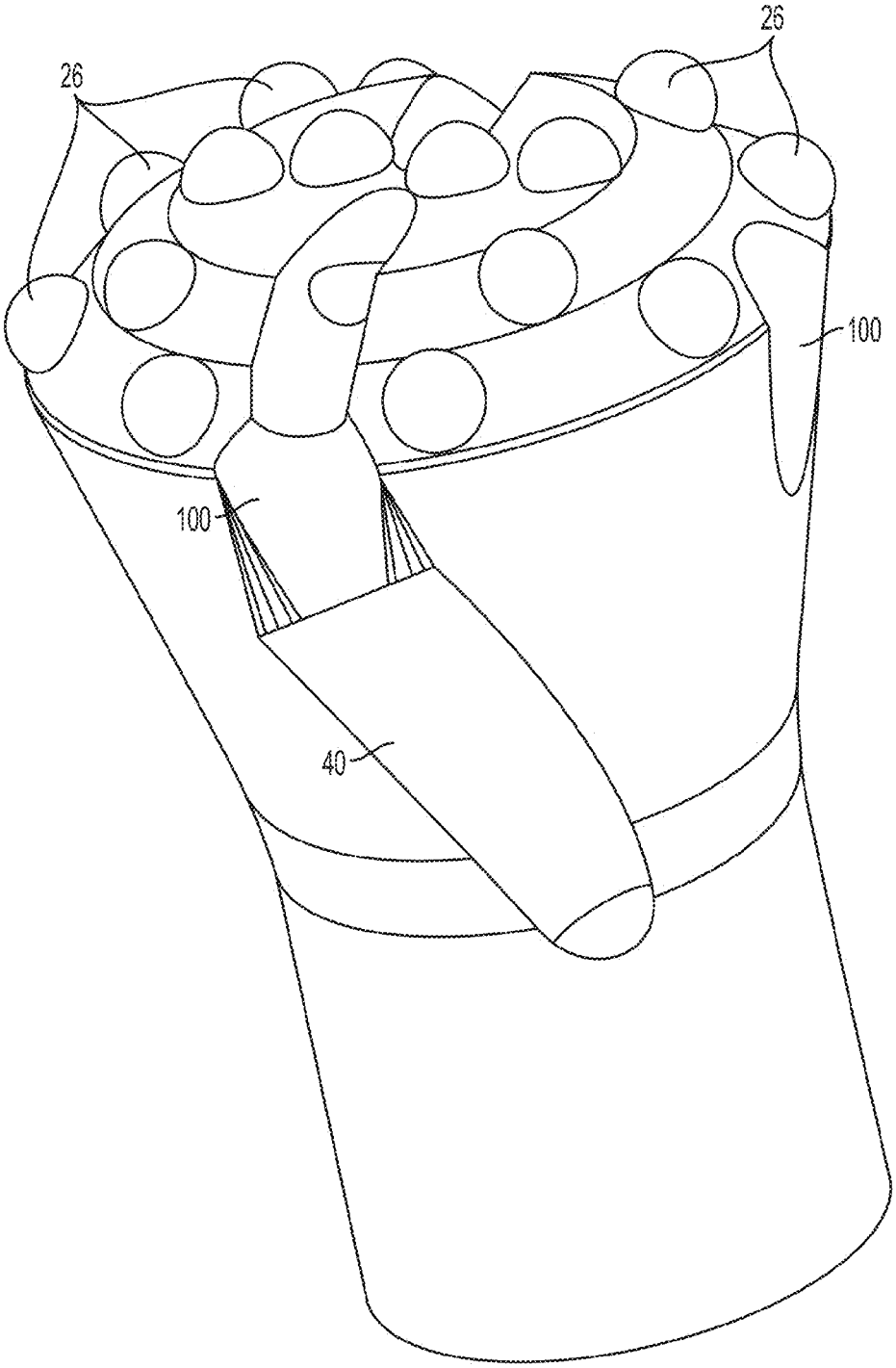

FIG. 7 depicts another exemplary reaming bit as disclosed herein. The reaming bit of FIG. 7 has at least two angled flutes, with at least one angled flute placed on each side of the bit face.

Figure 8:
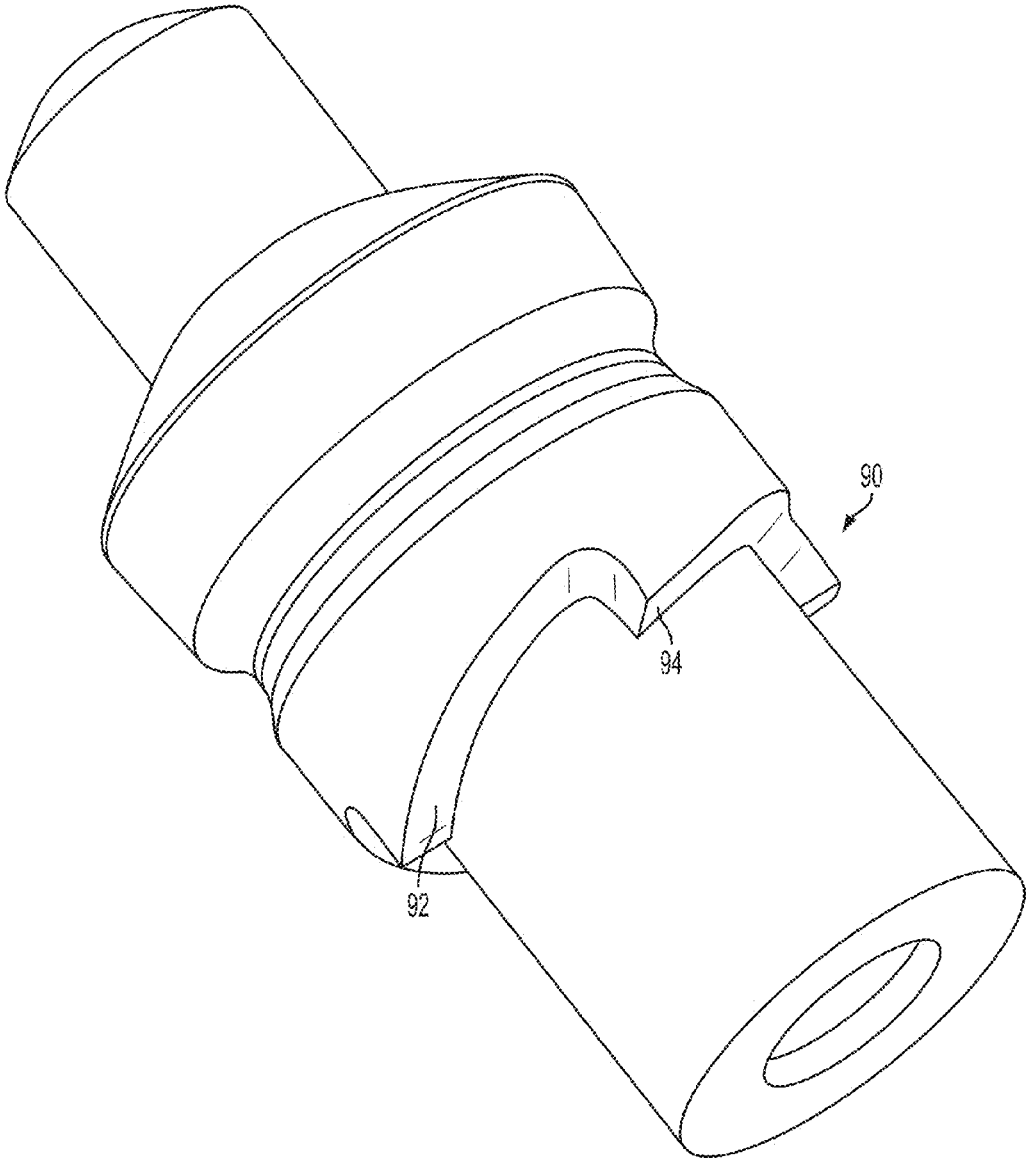

FIG. 8 depicts an exemplary pilot reamer having back cutting edges as disclosed herein.

FIGS. 9A-9D depicts an exemplary reaming bit having back cutting edges as disclosed herein.

Figure 10A:
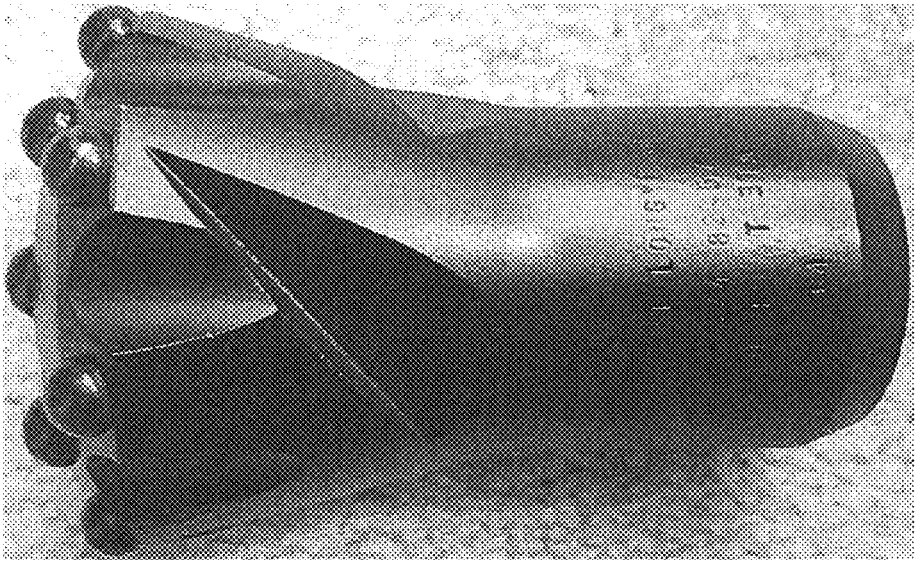
Figure 10B:
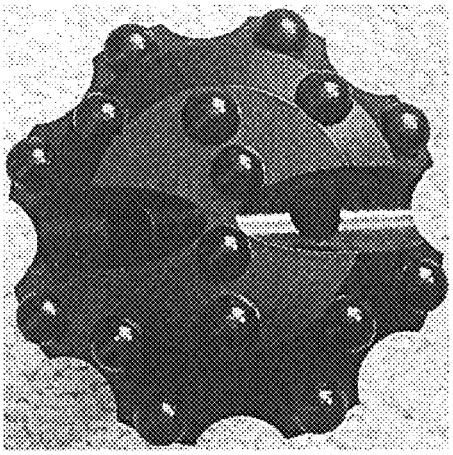

FIGS. 10A-10B are images of an exemplary reaming bit as disclosed herein prior to experimental testing.

Figure 11A:
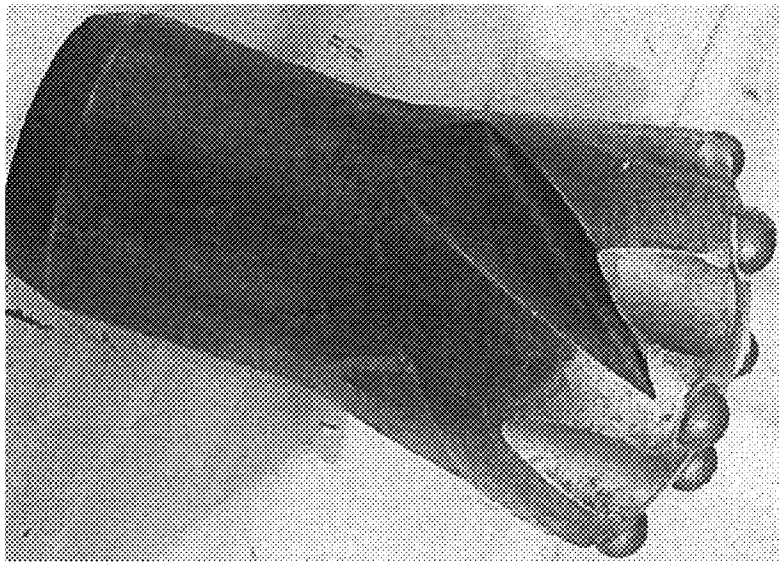
Figure 11B:
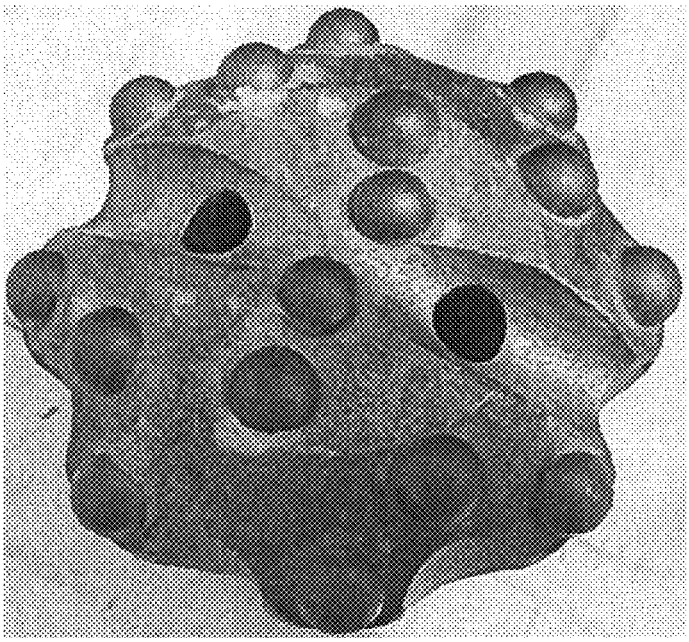

FIGS. 11A-11B are images of the reaming bit of FIGS. 10A-10B following completion of experimental testing.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a flushing channel" can include two or more such flushing channels unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Described herein with reference to FIGS. 1A-11B is a drill bit for use in drilling operations. In exemplary operations, the drill bit can form a hole within a drilling formation. Optionally, in some exemplary operations, the drilling formation can comprise rock. As described further herein, it is contemplated that the drill bits disclosed herein can increase drilling productivity without adding guidance features. Optionally, the drill bit can be a reaming bit. However, it is contemplated that the features disclosed herein can be employed in threaded bits (including, for example and without limitation, flat-face bits), down-the-hole bits, dome bits/hole-opener bits, pilot reamers, and the like without limitation.

In one aspect, the drill bit 10 can have a central longitudinal axis 12, a bit face 20 having a top surface 22, and a body portion 30 extending axially away from the bit face. As shown in FIGS. 1A-11B, it is contemplated that the top surface 22 of the bit face 20 can have a generally rounded profile. In another aspect, as shown in FIGS. 7, 10A-10B, and 11A-11B, the bit face 20 can optionally define, or be coupled to, at least one projection 26 or other surface element as is conventionally known in the art. In this aspect, it is contemplated that the at least one projection 26 can comprise a plurality of projections. In an additional aspect, the bit face 20 can define at least one bore 24. Optionally, the at least one bore 24 can be positioned proximate the central longitudinal axis 12 of the bit 10. In one aspect, it is contemplated that the at least one bore 24 can extend into an interior portion of the bit. It is further contemplated that the at least one bore can be configured to deliver fluid proximate the bit face.

In one aspect, at least one bore 24 can be in fluid communication with a longitudinally extending central channel 38 defined within the interior portion of the bit 10. In one aspect, the central channel 38 can be in selective communication with a source of pressurized flushing medium. In this aspect, it is contemplated that the pressurized flushing medium can be provided to the bit face 20 via the fluidly connected central channel 38 and the at least one bore 24. Optionally, in one exemplary aspect, at least one bore of the at least one bore 24 can be defined by the top surface 22 of the bit face 20. In this aspect, it is contemplated that a plurality of bores 24 can be defined by the top surface 22 of the bit face 20. In other exemplary aspects, it is contemplated that at least one bore of the at least one bore 24 can be defined by a side portion of the bit face 20. In further aspects, it is contemplated that the at least one bore 24 can be defined by a side portion of the body portion 30 of the drill bit 10 proximate the bit face 20.

In another aspect, the body portion 30 of the drill bit can have an exterior surface 32, a proximal portion 34, and a distal portion 36. In this aspect, the proximal portion 34 can define a plurality of surface features.

In a further aspect, as shown in FIGS. 1A-7 and 10A-11B, the body portion 30 of the bit 10 can cooperate with the bit face 20 to define a plurality of circumferentially spaced flushing channels 100. In this aspect, the plurality of surface features can cooperate with the plurality of flushing channels 100 to remove cuttings from the hole as the hole is formed. In this aspect, it is contemplated that the plurality of flushing channels 100 can be substantially equally spaced about the circumference of the bit face 20. In exemplary aspects, the plurality of flushing channels 100 can comprise 3, 4, 5, or 6 flushing channels (See FIGS. 5A-5E). However, it is contemplated that the plurality of flushing channels 100 can comprise any number of flushing channels that permits evacuation of cuttings as disclosed herein.

Drill Bits Having a Plurality of Flutes

In an exemplary aspect, as shown in FIGS. 1A-5E, 7, and 10A-11B, the plurality of surface features can comprise a plurality of flutes 40. In this aspect, each flute 40 of the plurality of flutes can be angularly oriented relative to the central axis 12 of the bit 10. Optionally, it is contemplated that at least a portion of each flute 40 can form a cutting element 42 configured for back reaming. In an additional aspect, it is contemplated that the cutting element 42 of each flute 40 of the plurality of flutes can define a cutting (leading) edge 44.

Optionally, it is contemplated that that at least one flute 40 can be positioned in fluid communication with at least one flushing channel 100. In exemplary aspects, a portion of each flute 40 of the plurality of flutes can be configured for fluid communication with a portion of at least one flushing channel 100 of the plurality of flushing channels. However, it is contemplated that any configuration of flutes 40 and flushing channels 100 can be used. For example, in some aspects, it is contemplated that the plurality of flutes 40 can function independently of the plurality of flushing channels 100. In these aspects, it is contemplated that the plurality of flutes 40 can be spaced from the plurality of flushing channels 100 relative to the central axis 12 of the bit 10. Thus, it is contemplated that the at least one flute 40 can be configured to be in fluid communication with the at least one flushing channel 100 and that, alternatively, in other exemplary aspects, the at least one flute 40 can be configured to not be in fluid communication with the at least one flushing channel 100.

In one exemplary aspect, each flute 40 can comprise a first wall surface 46 (substantially positioned within a first plane 47) and a second wall surface 48 (substantially positioned within a second plane 49). In this aspect, the first and second wall surfaces 46, 48 can be defined by the exterior surface 32 of the proximal portion 34 of the body portion 30 of the bit 10. In another aspect, it is contemplated that the second plane 49 (substantially containing the second wall surface 48) can be positioned at a selected orientation angle 50 relative to the first plane 47 (substantially containing the first wall surface 46). In one exemplary aspect, the orientation angle 50 can range from about 30° to about 130°. In another exemplary aspect, the orientation angle 50 can range from about 60° to about 100°. In yet another aspect, the orientation angle 50 can range from about 80° to about 95°. Optionally, it is contemplated that the second plane 49 (substantially containing the second wall surface 48) can be substantially transverse to the first plane 47 (substantially containing the first wall surface 46).

Figure 1A:
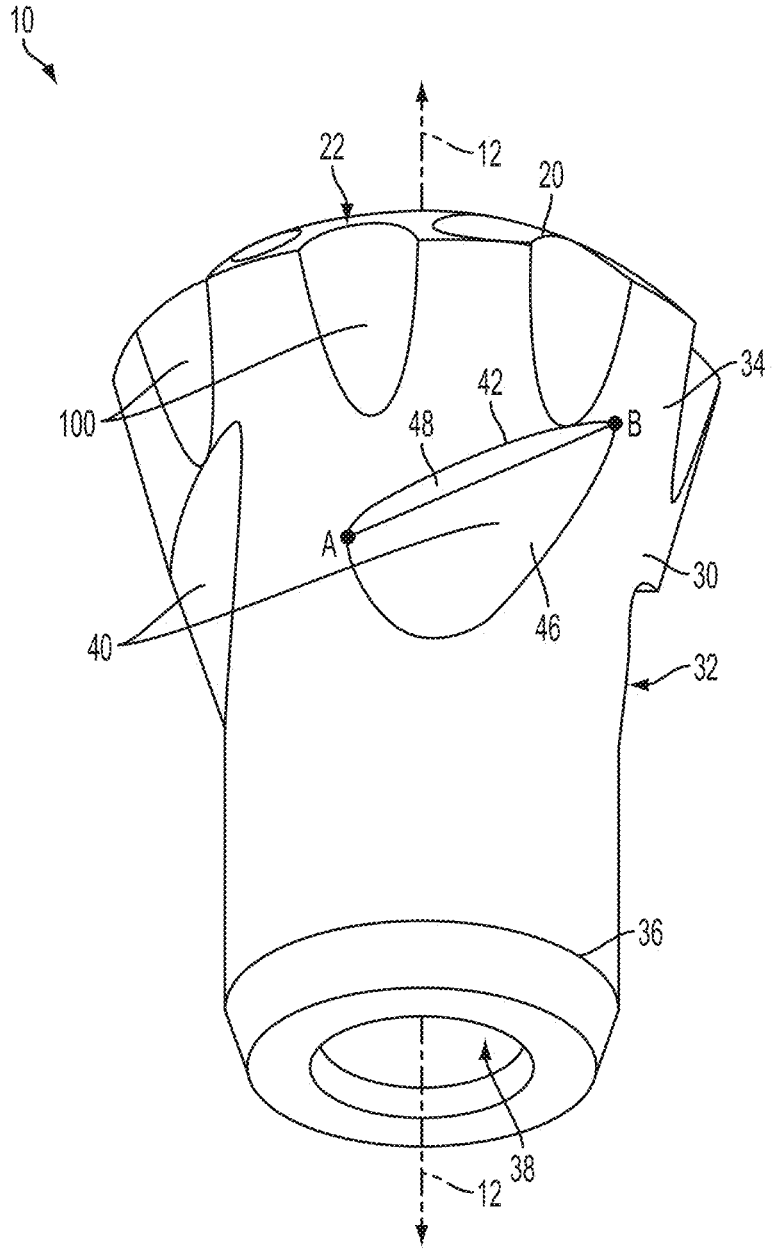
Figure 1B:
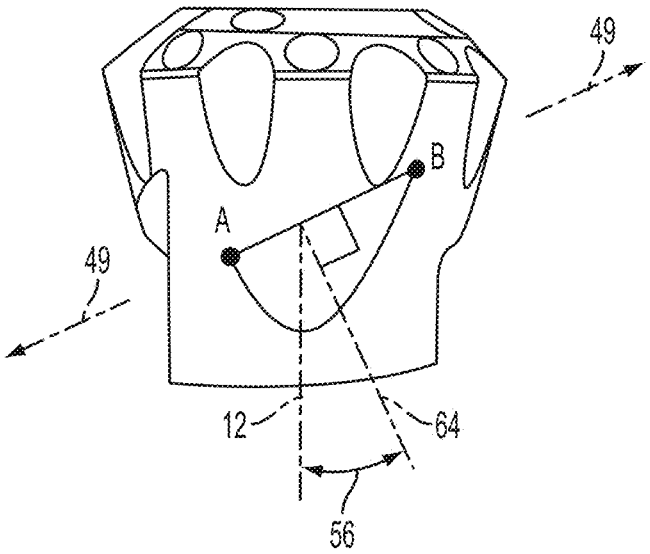
Figure 1C:
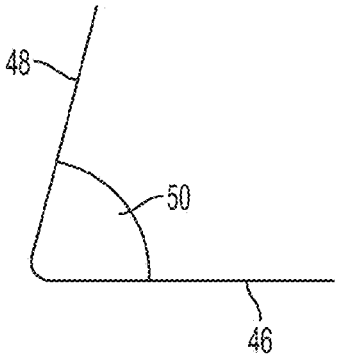
Figure 1D:
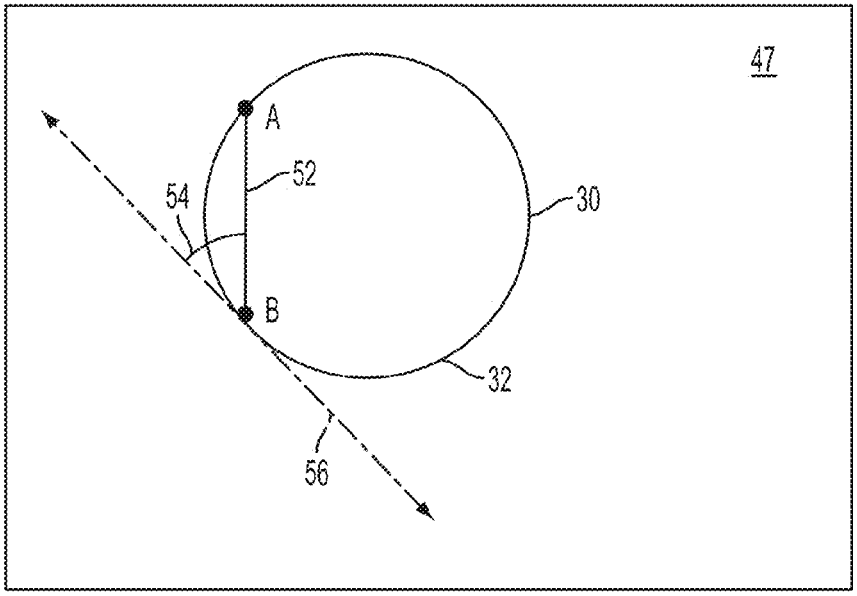
Figure 2:
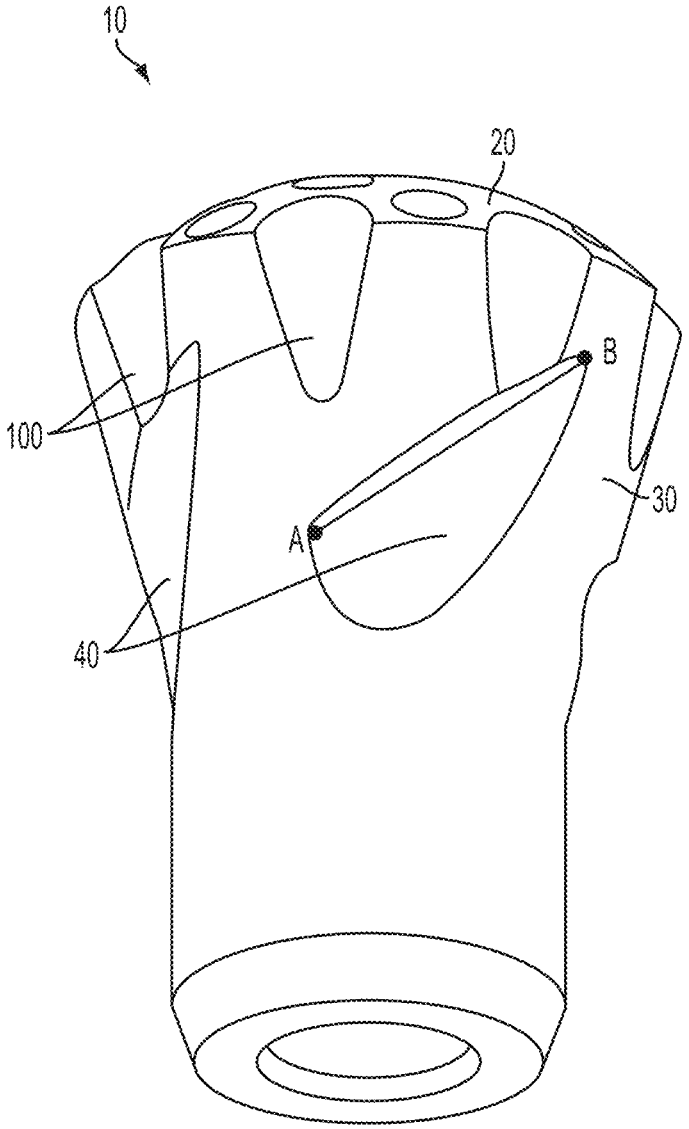
FIG. 2 depicts a front perspective view of another exemplary reaming bit.
Figure 3A:
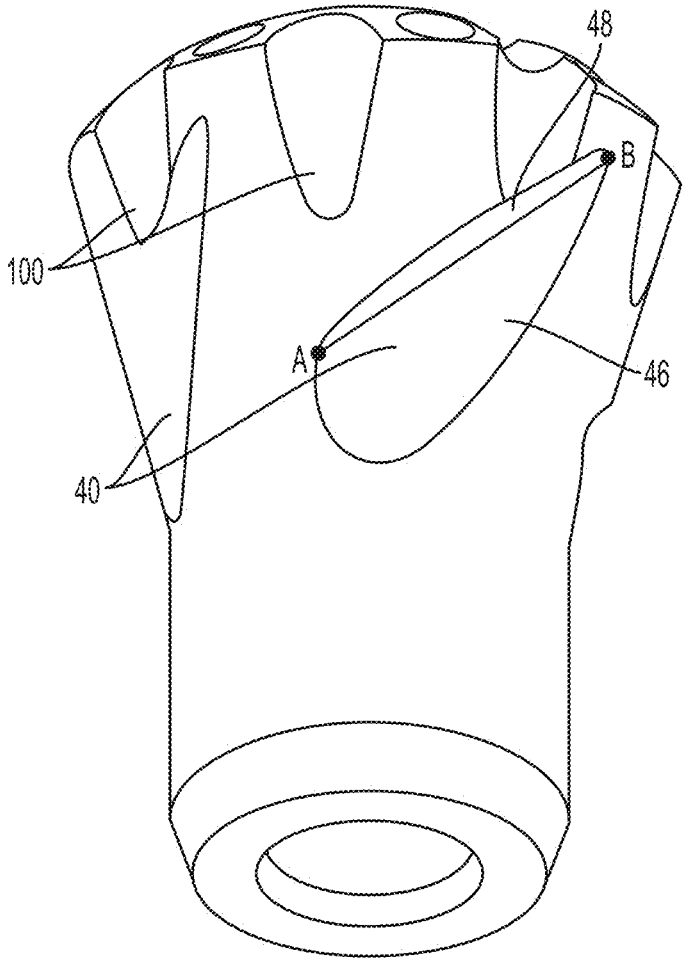
FIG. 3A is a front perspective view of an exemplary reaming bit, and FIG. 3B provides various technical views of the reaming bit.
Figure 3B:
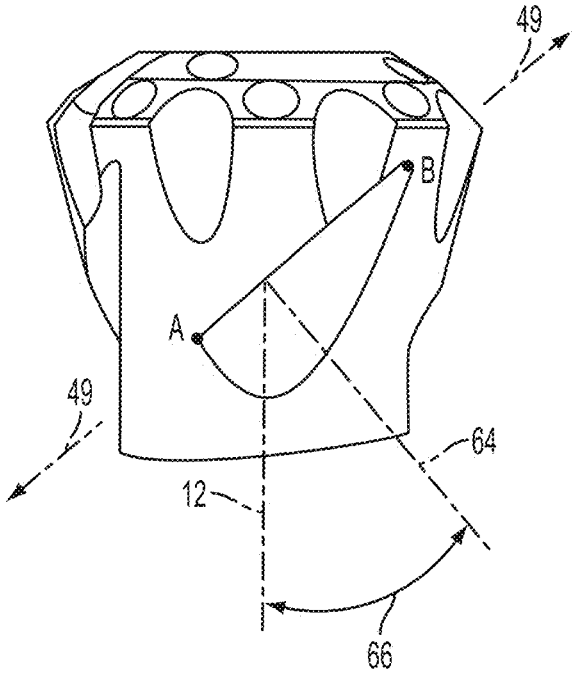

As illustrated in FIGS. 1A-5E and specifically shown in FIGS. 1B and 1D, the first plane 47 (substantially containing the first wall surface 46) can contain a planar chord AB extending from a first end point A to a second end point B. It is contemplated that the second end point B can be axially spaced from the first end point A in the direction of the bit face 20 relative to the longitudinal axis 12 of the bit 10. It is further contemplated that the second end point B can be positioned at the intersection of the first wall surface 46 and the exterior circumferential surface 32 of the body portion 30 of the bit 10. Optionally, the planar chord AB can be positioned substantially at the boundary between the first wall surface 46 and the second wall surface 48 (and substantially at the intersection between the first plane 47 and the second plane 49). In exemplary aspects, the planar chord AB can have a chord angle 54 that exemplarily ranges from about 5° to about 80°, where the chord angle is the angle formed by the planar chord AB and a tangent line 56 within the first plane 47. In these aspects, the planar chord AB and the tangent line 56 can intersect on the exterior circumferential surface 32 of the body portion 30 of the bit 10 at the second end point B. In other exemplary aspects, the chord angle 54 can range from about 20° to about 70°. In still other aspects, the chord angle 54 can range from about 30° to about 65°. In a further exemplary aspect, the chord angle 54 can be about 40°.

In a further aspect, and with reference to FIG. 1B, it is contemplated that the second wall surface 48 can be positioned such that a normal (perpendicular line) 64 extending from the second plane 49 (substantially containing the second wall surface) is positioned at a selected cutting angle 66 relative to the longitudinal axis 12 of the bit 10. In this aspect, it is contemplated that the selected cutting angle 66 can range from about 10° to about 120° relative to the longitudinal axis 12 of the bit 10. In another aspect, it is contemplated that the selected cutting angle 66 can range from about 20° to about 100° relative to the longitudinal axis 12 of the bit 10. In a further aspect, it is contemplated that the selected cutting angle 66 can range from about 25° to about 90° relative to the longitudinal axis 12 of the bit 10. In still another aspect, it is contemplated that the selected cutting angle 66 can range from about 30° to about 65°. In one exemplary aspect, the selected cutting angle 66 can be about 40°.

Optionally, it is contemplated that each flute 40 of the plurality of flutes can have a substantially helical profile. In an additional aspect, the cutting element 42 of each helically shaped flute 40 of the plurality of flutes can define a leading (cutting) edge 44 that is configured for back reaming.

Optionally, in other exemplary aspects, as shown in FIG. 7, it is contemplated that the plurality of helical flutes 40 can be positioned in a substantially vertical orientation. In these aspects, it is contemplated that at least one flute 40 of the plurality of flutes can cooperate with at least one flushing channel to define a continuous pathway for receiving fluid and/or cuttings as disclosed herein. Optionally, it is contemplated that each flute 40 of the plurality of flutes can be oriented substantially parallel to the longitudinal axis 12 of the bit 10.

Drill Bits Having a Back Face with a Cutting Profile

Figure 9A:
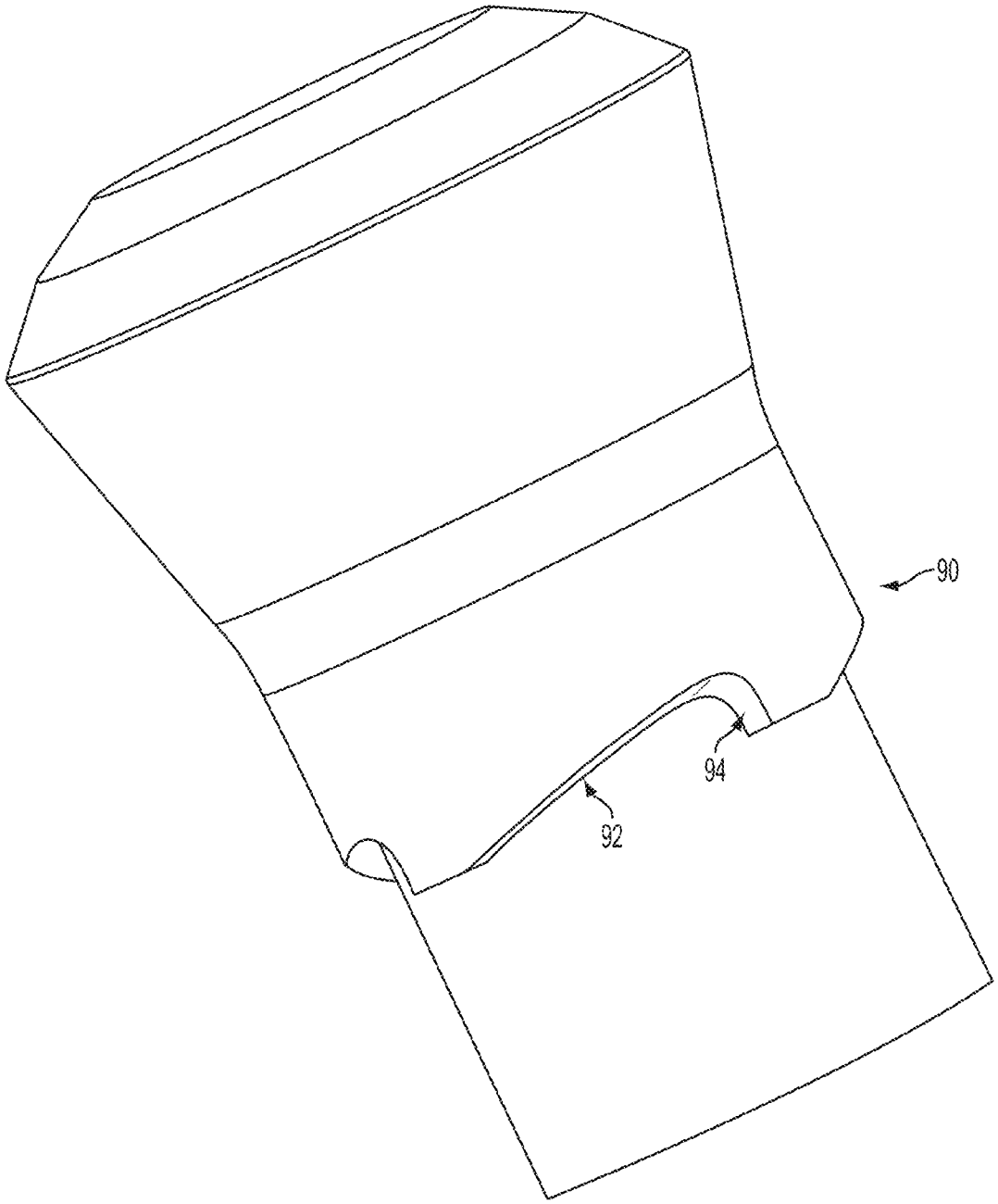
Figure 9B:
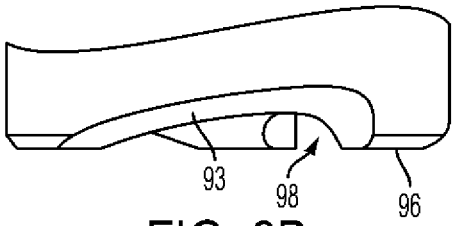
Figure 9C:
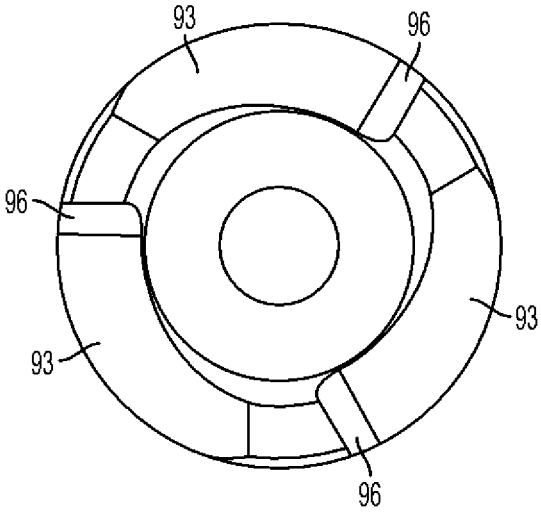
Figure 9D:
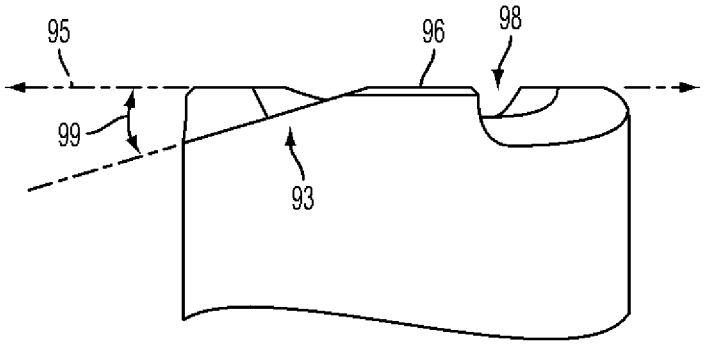

Optionally, in exemplary aspects, and with reference to FIGS. 8-9D, it is contemplated that the proximal portion 34 of the body portion 30 of the bit 10 can have a back face 90 that is provided with a cutting profile 92 that comprises at least one cutting edge 94 that is configured for back reaming. In exemplary aspects, the at least one cutting edge 94 defined on the back face 90 can have a substantially saw-tooth cutting profile. It is contemplated that the at least one cutting edge 94 of the back face 90 can be configured to cut and/or agitate cuttings, thereby promoting removal of the bit 10 from the hole and increasing the productivity of drilling operations.

In exemplary aspects, the cutting profile 92 can comprise a plurality of back cutting teeth 96. In these aspects, the plurality of teeth 96 can be circumferentially spaced about the back face 90. Optionally, it is contemplated that the plurality of teeth 96 can be substantially equally circumferentially spaced about the back face 90. In an additional aspect, it is contemplated that each tooth 96 of the plurality of teeth can define a respective cutting edge 94 of the back face 90. In one exemplary aspect, the plurality of back cutting teeth 96 can comprise three back cutting teeth.

In other aspects, the cutting profile 92 can comprise a plurality of recessed portions 98 positioned between adjacent teeth 96 of the plurality of back cutting teeth. For example, in one aspect, when the plurality of back cutting teeth 96 comprises three teeth, it is contemplated that the plurality of recessed portions 98 can comprise three recessed portions. In further aspects, the recessed portions 98 can be defined by corresponding sloped portions 93 of the cutting profile 92. In these aspects, as shown in FIGS. 9B-9D, it is contemplated that the sloped portions 93 of the cutting profile 92 can be oriented at a selected angle 99 relative to a plane 95 positioned perpendicular to the longitudinal axis 12 of the bit 10. It is further contemplated that the selected angle 99 can range from about 5° to about 45°. In one exemplary aspect, it is contemplated that the selected angle 99 can range from about 10° to about 30°. In another exemplary aspect, it is contemplated that the selected angle 99 can range from about 15° to about 20°.

Drill Bits Having a Plurality of Fins

In another exemplary aspect, and with reference to FIG. 6, the plurality of surface features of the drill bit can optionally comprise a plurality of fins 70 that project outwardly from the body portion 30 of the bit 10. In this aspect, the plurality of fins 70 can be configured to act as cutting elements that are configured for back reaming. In this aspect, it is contemplated that at least one fin 70 of the plurality of fins can be positioned in communication with at least one flushing channel 100 of the bit 10. It is further contemplated that each fin 70 of the plurality of fins can be positioned in communication with at least one flushing channel 100 of the bit 10. However, it is contemplated that any configuration of fins 70 and flushing channels 100 can be used. For example, in some aspects, it is contemplated that the plurality of fins 70 can function independently of the plurality of flushing channels 100. In these aspects, it is contemplated that the plurality of fins 70 can be spaced from the plurality of flushing channels 100 relative to the central axis 12 of the bit 10. Thus, it is contemplated that the at least one fin 70 can be configured to be in fluid communication with the at least one flushing channel 100 and that, alternatively, in other exemplary aspects, the at least one fin 70 can be configured to not be in fluid communication with the at least one flushing channel 100.

It is further optionally contemplated that the fins 70 can optionally have a substantially helical profile. In use, it is contemplated that the fins 70 can function in the same general manner as the flutes disclosed herein, thereby improving productivity of drilling operations.

Drill Bits Having a Plurality of Ribs

In still another exemplary aspect, and with reference to FIG. 6, the plurality of surface features of the drill bit 10 can optionally comprise a plurality of ribs 80 that project outwardly from the body portion 30 of the bit 10. In this aspect, the plurality of ribs 80 can be configured to act as cutting elements that are configured for back reaming. In this aspect, it is contemplated that at least one rib 80 can be positioned in fluid communication with at least one flushing channel 100 of the bit. It is further contemplated that each rib 80 of the plurality of ribs can be positioned in communication with at least one flushing channel 100 of the bit 10. However, it is contemplated that any configuration of ribs 80 and flushing channels 100 can be used. For example, in some aspects, it is contemplated that the plurality of ribs 80 can function independently of the plurality of flushing channels 100. In these aspects, it is contemplated that the plurality of ribs 80 can be spaced from the plurality of flushing channels 100 relative to the central axis 12 of the bit 10. Thus, it is contemplated that the at least one rib 80 can be configured to be in fluid communication with the at least one flushing channel 100 and that, alternatively, in other exemplary aspects, the at least one rib 80 can be configured to not be in fluid communication with the at least one flushing channel 100.

It is further contemplated that the ribs 80 can be positioned at a selected angle relative to the central axis 12 of the bit. In use, it is contemplated that the ribs 80 can function in the same general manner as the flutes and fins disclosed herein, thereby improving productivity of drilling operations.

In exemplary aspects, it is contemplated that the plurality of surface features can comprise at least two of the flutes 40, fins 70, and ribs 80 as disclosed herein. Thus, it is contemplated that the plurality of surface features can comprise at least one flute 40 and at least one fin 70. Similarly, it is contemplated that the plurality of surface features can comprise at least one flute 40 and at least one rib 80. It is further contemplated that the plurality of surface features can comprise at least one fin 70 and at least one rib 80. It is still further contemplated that the plurality of surface features can comprise at least one flute 40, at least one fin 70, and at least one rib 80.

Use of the Drill Bits

In use, it is contemplated that the disclosed drill bit can be placed into contact with a formation and advanced relative to the formation in a conventional manner to form a drill hole. It is contemplated that the plurality of surface features can cooperate with the plurality of flushing channels to evacuate cuttings and thereby promote removal of the drill string from a drill hole, such as, for example and without limitation, a drill hole formed within a rock formation. It is contemplated that the cuttings can be generally carried through the flushing channels and the surface features by the pressurized flushing medium that is generally confined between the flushing channels and an inner wall surface of the formed hole. It is further contemplated that the absence of guidance diameter on the bit can permit the bit to better follow a pilot hole and "float" within the reamed hole without contacting the interior edges of the hole.

In operation, it is contemplated that drill strings comprising one of the disclosed drill bits can be removed from a hole more quickly and with less resistance than drill strings comprising a conventional drill bit. More particularly, it is contemplated that the disclosed drill bits can increase productivity by biting into jammed cuttings and effectively evacuating the cuttings through the flushing channels and other surface features disclosed herein.

EXAMPLES

In one experimental test, the performance of a high-productivity reaming bit as disclosed herein was compared to the performance of a conventional reaming bit. Both bits were connected to a Montabert drilling machine and used to drill four 16-foot holes in unconsolidated broken ground. FIGS. 10A-10B display images of the high-productivity reaming bit prior to drilling of the holes. FIGS. 11A-11B display images of the high-productivity reaming bit after drilling of the holes.

The high-productivity reaming bit was able to penetrate 16 feet within about three minutes. The extraction time for the high-productivity reaming bit was around ten seconds on average, whereas the extraction time for the conventional reaming bit was around eight minutes on average. The high-productivity reaming bit exhibited more stability (less wandering) compared to the conventional reaming bit, and the high-productivity reaming bit produced straighter holes than the conventional reaming bit.

Exemplary Drill Bits

In exemplary aspects, a drill bit for forming a hole within a formation is provided, the drill bit having a central longitudinal axis and comprising: a bit face having a top surface; and a body portion extending axially away from the bit face, the body portion having an exterior surface and a proximal portion that defines a plurality of flutes within the exterior surface of the body portion, each flute of the plurality of flutes being angularly oriented relative to the central longitudinal axis, wherein the body portion and the bit face cooperate to define a plurality of circumferentially spaced flushing channels, and wherein the plurality of flutes cooperate with the plurality of flushing channels to remove cuttings from the hole as the hole is formed.

In another exemplary aspect, the body portion defines a central channel configured to receive a flushing medium, wherein the top surface of the bit face defines at least one bore positioned in fluid communication with the central channel.

In another exemplary aspect, at least a portion of each flute forms a cutting element configured for back reaming.

In another exemplary aspect, each flute of the plurality of flutes comprises a first substantially planar wall surface and a second substantially planar wall surface.

In another exemplary aspect, the first wall surface of each flute of the plurality of flutes is positioned in a first plane containing a planar chord that has a chord angle formed by the planar chord and a tangent line within the first plane that intersect on the exterior surface of the body portion at an end intersection of the first wall surface and the exterior surface of the body portion, wherein the chord angle ranges from about 5° to about 60°.

In another exemplary aspect, the second wall surface of each flute of the plurality of flutes is positioned in a second plane positioned at an orientation angle relative to the first plane, wherein the orientation angle ranges from about 30° to about 130°. In another exemplary aspect, the orientation angle ranges from about 60° to about 100°. In another exemplary aspect, the orientation angle ranges from about 80° to about 95°. In another exemplary aspect, the second wall surface is substantially transverse to the first wall surface.

In another exemplary aspect, the second wall surface is positioned such that a normal extending from the second wall surface is positioned at a cutting angle with respect to the central longitudinal axis of the drill bit.

In another exemplary aspect, the cutting angle ranges from about 10° to about 120°. In another exemplary aspect, the cutting angle ranges from about 20° to about 100°. In another exemplary aspect, the cutting angle ranges from about 25° to about 90°.

In another exemplary aspect, each flute of the plurality of flutes has a substantially helical profile.

In another exemplary aspect, the bit face defines at least one projection extending from the top surface of the drill bit.

In other exemplary aspects, a drill bit for forming a hole within a formation can be provided, the drill bit having a central longitudinal axis and comprising: a bit face having a top surface; and a body portion extending axially away from the bit face, the body portion having an exterior surface and a proximal portion that defines a plurality of surface features, wherein the body portion and the bit face cooperate to define a plurality of circumferentially spaced flushing channels, and wherein the plurality of surface features cooperate with the plurality of flushing channels to remove cuttings from the hole as the hole is formed.

In another exemplary aspect, the plurality of surface features comprise a plurality of flutes defined within the exterior surface of the body portion, each flute of the plurality of flutes being angularly oriented relative to the central longitudinal axis.

In another exemplary aspect, the plurality of surface features comprise a plurality of fins that project outwardly from the body portion, wherein each fin of the plurality of fins is positioned in communication with at least one flushing channel of the plurality of flushing channels. In another exemplary aspect, each rib of the plurality of fins is spaced from the plurality of flushing channels such that the plurality of fins function independently of the plurality of flushing channels.

In another exemplary aspect, the plurality of surface features comprise a plurality of ribs that project outwardly from the proximal potion of the body portion, wherein each rib of the plurality of ribs is positioned in communication with at least one flushing channel of the plurality of flushing channels. In another exemplary aspect, each rib of the plurality of ribs is spaced from the plurality of flushing channels such that the plurality of ribs function independently of the plurality of flushing channels.

In another exemplary aspect, each rib of the plurality of ribs has a longitudinal axis that is angularly oriented relative to a plane containing the central longitudinal axis of the drill bit.

In another exemplary aspect, at least a portion of each surface feature of the plurality of surface features is configured for back reaming, In a further exemplary aspect, a method of forming a hole within a formation comprises: positioning a drill bit in contact with a formation, the drill bit having a central longitudinal axis and comprising: a bit face having a top surface; and a body portion extending axially away from the bit face, the body portion having an exterior surface and a proximal portion that defines a plurality of flutes within the exterior surface of the body portion, each flute of the plurality of flutes being angularly oriented relative to the central longitudinal axis, wherein the body portion and the bit face cooperate to define a plurality of circumferentially spaced flushing channels; and advancing the drill bit within the formation to form the hole, wherein the plurality of flutes cooperate with the plurality of flushing channels to remove cuttings from the hole as the hole is formed. In another exemplary aspect, the formation is a rock formation.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A rock drill bit for evacuating cuttings from a drill hole within a rock formation, the drill bit having a central longitudinal axis and comprising:

a bit face having a top surface; and a body portion extending axially away from the bit face, the body portion having an exterior surface and a proximal portion that defines a plurality of flutes within the exterior surface of the body portion, each flute of the plurality of flutes being angularly oriented relative to the central longitudinal axis, wherein each flute of the plurality of flutes comprises a first substantially planar wall surface and a second substantially planar wall surface, wherein the body portion and the bit face enclose an interior portion of the bit, and wherein the body portion defines a central channel within the interior portion of the bit that is configured to receive a flushing medium, wherein the top surface of the bit face defines a plurality of bores positioned in fluid communication with the central channel, and wherein the exterior surface of the body portion and the bit face cooperate to define a plurality of circumferentially spaced flushing channels, wherein at least one flushing channel of the plurality of circumferentially spaced flushing channels is positioned in fluid communication with each bore of the plurality of bores of the bit face, and wherein the plurality of flutes cooperate with the plurality of flushing channels to remove cuttings from the hole.

2. The rock drill bit of claim 1, wherein at least a portion of each flute forms a cutting element configured for back reaming.

3. The rock drill bit of claim 2, wherein each flute of the plurality of flutes has a substantially helical profile.

4. The rock drill bit of claim 1, wherein the first wall surface of each flute of the plurality of flutes is positioned in a first plane, wherein the second wall surface of each flute of the plurality of flutes is positioned in a second plane positioned at an orientation angle relative to the first plane, and wherein the orientation angle ranges from about 30° to about 130°.

5. The rock drill bit of claim 4, wherein the orientation angle ranges from about 60° to about 100°.

6. The rock drill bit of claim 4, wherein the orientation angle ranges from about 80° to about 95°.

7. The rock drill bit of claim 4, wherein each flute comprises a planar chord positioned at the boundary between the first wall surface and the second wall surface, wherein the planar chord extends from a first end point to a second end point, and wherein the second endpoint is axially spaced from the first end point in the direction of the bit face relative to the central longitudinal axis of the drill bit.

8. The rock drill bit of claim 1, wherein the second wall surface is substantially transverse to the first wall surface.

9. The rock drill bit of claim 1, wherein the second wall surface is positioned such that a normal extending from the second wall surface is positioned at a cutting angle with respect to the central longitudinal axis of the drill bit.

10. The rock drill bit of claim 9, wherein the cutting angle ranges from about 10° to about 120°.

11. The rock drill bit of claim 10, wherein the cutting angle ranges from about 20° to about 100°.

12. The rock drill bit of claim 10, wherein the cutting angle ranges from about 25° to about 90°.

13. The rock drill bit of claim 1, wherein the bit face comprises at least one projection extending from the top surface of the drill bit.

14. The rock drill bit of claim 1, wherein a first flute of the plurality of flutes is positioned in fluid communication with a corresponding flushing channel of the plurality of circumferentially spaced flushing channels, and wherein a portion of the first flute contacts a portion of its corresponding flushing channel.

15. A method of evacuating cuttings from a drill hole, comprising:

positioning a rock drill bit within the drill hole formed within a rock formation, the drill bit having a central longitudinal axis and comprising:

a bit face having a top surface; and a body portion extending axially away from the bit face, the body portion having an exterior surface and a proximal portion that defines a plurality of flutes within the exterior surface of the body portion, each flute of the plurality of flutes being angularly oriented relative to the central longitudinal axis, wherein each flute of the plurality of flutes comprises a first substantially planar wall surface and a second substantially planar wall surface, wherein the body portion and the bit face enclose an interior portion of the bit, and wherein the body portion defines a central channel within the interior portion of the bit, wherein the top surface of the bit face defines a plurality of bores positioned in fluid communication with the central channel, and wherein the exterior surface of the body portion and the bit face cooperate to define a plurality of circumferentially spaced flushing channels, wherein at least one flushing channel of the plurality of circumferentially spaced flushing channels is positioned in fluid communication with each bore of the plurality of bores of the bit face; and delivering a flushing medium to the bit face through the central channel and each bore of the plurality of bores, wherein the plurality of flutes cooperate with the plurality of flushing channels to remove cuttings from the hole.

16. The method of claim 15, wherein, following delivery of the flushing medium to the bit face, the flushing medium travels through the plurality of flushing channels and the plurality of flutes to remove cuttings from the hole.

17. A rock drill bit for evacuating cuttings from a drill hole within a rock formation, the drill bit having a central longitudinal axis and comprising:

a bit face having a top surface; and a body portion extending axially away from the bit face, the body portion having an exterior surface and a proximal portion that defines a plurality of flutes within the exterior surface of the body portion, each flute of the plurality of flutes being angularly oriented relative to the central longitudinal axis, wherein each flute of the plurality of flutes comprises a first substantially planar wall surface and a second substantially planar wall surface, wherein the second wall surface is substantially transverse to the first wall surface, and wherein the body portion defines a central channel that is configured to receive a flushing medium, wherein the top surface of the bit face defines at least one bore positioned in fluid communication with the central channel, and wherein the exterior surface of the body portion and the bit face cooperate to define a plurality of circumferentially spaced flushing channels, wherein at least one flushing channel of the plurality of circumferentially spaced flushing channels is positioned in fluid communication with the at least one bore of the bit face, and wherein the plurality of flutes cooperate with the plurality of flushing channels to remove cuttings from the hole.

18. The rock drill bit of claim 17, wherein at least a portion of each flute forms a cutting element configured for back reaming.

19. The rock drill bit of claim 18, wherein each flute of the plurality of flutes has a substantially helical profile.

20. The rock drill bit of claim 17, wherein the first wall surface of each flute of the plurality of flutes is positioned in a first plane, wherein the second wall surface of each flute of the plurality of flutes is positioned in a second plane positioned at an orientation angle relative to the first plane, and wherein the orientation angle ranges from about 30° to about 130°.

21. The rock drill bit of claim 17, wherein the second wall surface is positioned such that a normal extending from the second wall surface is positioned at a cutting angle with respect to the central longitudinal axis of the drill bit, and wherein the cutting angle ranges from about 10° to about 120°.

22. The rock drill bit of claim 17, wherein the bit face comprises at least one projection extending from the top surface of the drill bit.

* * * * *